US005268704A

United States Patent [19]

Hasegawa et al.

[11] Patent Number: 5,268,704

[45] Date of Patent: Dec. 7, 1993

[54] THERMAL TRANSFER RECORDING METHOD REDUCING GROUND STAINING AND IMPROVING INK TRANSFERABILITY

[75] Inventors: Tetsuo Hasegawa, Tokyo; Takayuki Suzuki, Saitama; Naoki Kushida, Yokohama; Yoshihisa Takizawa, Kawasaki, all of Japan

[73] Assignee: Canon Kabushiki Kaisha, Tokyo, Japan

[21] Appl. No.: 905,527

[22] Filed: Jun. 29, 1992

Related U.S. Application Data

[62] Division of Ser. No. 472,792, Jan. 31, 1990, Pat. No. 5,147,707.

[30] Foreign Application Priority Data

| | | | |
|---|---|---|---|
| Feb. 2, 1989 | [JP] | Japan | 1-025278 |
| Jul. 31, 1989 | [JP] | Japan | 1-198251 |
| Jul. 31, 1989 | [JP] | Japan | 1-198253 |
| Jul. 31, 1989 | [JP] | Japan | 1-198254 |
| Jul. 31, 1989 | [JP] | Japan | 1-198256 |
| Jul. 31, 1989 | [JP] | Japan | 1-198273 |

[51] Int. Cl.[5] ..... B41J 2/32; B41J 31/00

[52] U.S. Cl. ..... 346/1.1; 346/76 PH; 400/237; 400/241; 400/241.1

[58] Field of Search ..... 346/1.1, 76 PH; 400/237, 241, 241.1

[56] References Cited

U.S. PATENT DOCUMENTS

| | | | |
|---|---|---|---|
| 3,368,989 | 2/1968 | Wissinger et al. | 260/23 |
| 4,564,534 | 1/1986 | Kushida et al. | 427/256 |
| 4,624,891 | 11/1986 | Sato et al. | 428/321.3 |
| 4,743,920 | 5/1988 | Tohma et al. | 346/71 |
| 4,880.324 | 11/1989 | Sato et al. | 400/241 |
| 4,880,686 | 11/1989 | Yaegashi et al. | 428/212 |
| 4,882,593 | 11/1989 | Touma et al. | 346/111 |
| 4,960,632 | 10/1990 | Tohma et al. | 428/212 |
| 5,008,683 | 4/1991 | Goto et al. | 346/1.1 |
| 5,049,903 | 9/1991 | Suzuki | 346/135.1 |

FOREIGN PATENT DOCUMENTS

| | | |
|---|---|---|
| 3825437 | 11/1989 | Fed. Rep. of Germany . |
| 55-105579 | 8/1980 | Japan . |
| 57-83471 | 5/1982 | Japan . |
| 58-7377 | 1/1983 | Japan . |
| 0201686 | 11/1983 | Japan . |
| 60-178088 | 9/1985 | Japan . |
| 62-27179 | 2/1987 | Japan . |
| 62-60691 | 3/1987 | Japan . |
| 63-89396 | 4/1988 | Japan . |

OTHER PUBLICATIONS

Eur. Pat. Off. Search Report for Eur. Pat. Appln. 90101851.5.

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

Thermal transfer recording is improved by a recording method involving providing a thermal transfer material having a support and an ink layer disposed thereon and which in turn includes a binder and a colorant. The binder includes 45–70 wt. % of an ethylene-vinyl acetate copolymer, 25–50 wt. % of a wax, and 7–12 wt. % of a tackifier based on a total weight of the binder. The ink layer has a breakdown strength of 30–80 kg/cm$^2$ at 25° C. The method also involves contacting an ink layer side of the thermal transfer material with a recording medium, supplying a pattern of energy from a recording head to the thermal transfer material, and separating the thermal transfer material from the recording medium to leave a transferred image on the recording medium. The thermal transfer material moves in a unit period of time by a first distance relative to the recording head which is smaller than a second distance through which the recording medium moves relative to the recording head in the same unit period of time.

15 Claims, 3 Drawing Sheets

THERMAL TRANSFER RECORDING METHOD REDUCING GROUND STAINING AND IMPROVING INK TRANSFERABILITY

This application is a division of application Ser. No. 07/472,792, filed Jan. 31, 1990, now U.S. Pat. No. 5,147,707.

FIELD OF THE INVENTION AND RELATED ART

The present invention relates to a thermal transfer material for use in a thermal transfer recording method, particularly to a thermal transfer material capable of providing good recorded images even when used in a smaller amount than that in the conventional thermal transfer recording method.

The thermal or heat-sensitive transfer recording method has recently been widely used because it has general advantages of the thermal recording method such that the apparatus employed is light in weight, compact, free of noise, excellent in operability and adapted to easy maintenance, and also has other advantages such that it does not require a color-formation type converted paper but provides recorded images with excellent durability.

However, in the conventional thermal transfer recording method, since the heat-transferable ink layer of a thermal transfer material is nearly completely transferred to a recording medium (or medium to be recorded) after one heat application, the thermal transfer material is discarded after a single use, whereby the running cost becomes high. Further, the conventional thermal transfer material has a disadvantage such that secrets can be leaked out from the used thermal transfer material.

On the other hand, there have been proposed a large number of methods wherein one thermal transfer material is repeatedly used plural times as disclosed in Japanese Laid-Open Patent Application (JP-A, KOKAI) No. 105579/1980, or a thermal transfer material has a relative velocity with respect to a recording medium so that the amount of the thermal transfer material to be consumed may be reduced, as described in Japanese Laid-Open Patent Application Nos. 83471/1982 and 7377/1983.

However, these conventional methods have some problems as described below.

One of these problems is that ground staining (i.e., unnecessary transfer of an ink) is liable to occur on a recording medium such as paper. This may be attributable to a phenomenon such that a thermal transfer material is rubbed with the recording medium in the above-mentioned recording method, and therefore the ink layer of the thermal transfer material is worn off by the surface of the recording medium, whereby a portion of the ink layer is transferred to the entire surface of the recording medium.

Another problem is that unnecessary transfer 20 of an ink in the form of whiskers or bristles occurs in the trailing edge portion of the transferred ink layer with respect to the moving direction of a thermal head, (i.e., the direction of relative velocity of the thermal head with respect to the recording medium, hereinafter, such unnecessary transfer is referred to as "whisker edge portion"), as shown in FIG. 6 described hereinafter. This may be attributable to a phenomenon such that the melt viscosity of the ink layer is considerably decreased due to plural heat applications to the same portion of the ink layer, and the thermal transfer material is rubbed with the recording medium in the above-mentioned conventional recording method.

In order to solve the problem of the above-mentioned ground staining, Japanese Laid-Open Patent Application No. 178088/1985 proposes an overcoating layer containing no colorant which is disposed on an ink layer. However, such an overcoating layer is transferred to a recording medium after the first heat application, and therefore the problem of the whisker end portion is not solved.

Our research group has proposed a thermal transfer material to be used for the above-mentioned recording method, wherein the ink layer has a specific melt viscosity (U.S. patent application Ser. No. 367,482 now U.S. Pat. No. 5,049,903).

SUMMARY OF THE INVENTION

An object of the present invention is, in view of the above-mentioned problems, to provide a thermal transfer material capable of preventing ground staining and whisker end portion formation even when used in a recording method wherein the thermal transfer material has a relative velocity with respect to a recording medium (hereinafter, simply referred to as "double density recording").

Another object of the present invention is to provide a thermal transfer recording method using such a thermal transfer material.

According to the present invention, there is provided a thermal transfer material comprising a support and an ink layer disposed thereon comprising a binder and a colorant, wherein the binder comprises 40 -80 wt. % of an ethylene-vinyl acetate copolymer and 20–60 wt. % of a wax based on the total weight of the binder, and the ink layer has a breakdown strength of 30–80 kg/cm$^2$ at 25° C.

The present invention also provides a thermal transfer recording method, comprising:

providing a thermal transfer material as described above;

causing the thermal transfer material to contact a recording medium with its ink layer side;

supplying a pattern of energy from a recording head to the thermal transfer material; and separating the thermal transfer material from the recording medium to leave a transferred image on the recording medium;

wherein the thermal transfer material moves in a unit period of time through a length of distance relative to the recording head, which is smaller than the length of distance relative to the recording head through which the recording medium moves in the same period of time.

These and other objects, features and advantages of the present invention will become more apparent upon a consideration of the following description of the preferred embodiments of the present invention taken in conjunction with the accompanying drawings, wherein like parts are denoted by like reference numerals. In the description appearing hereinafter, "part(s)" and "%" used for describing quantities are by weight unless otherwise noted specifically.

DETAILED DESCRIPTION OF THE INVENTION

Figure 2:
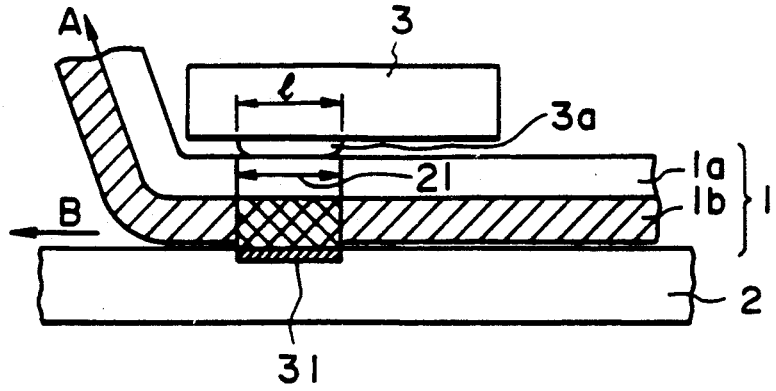
FIGS. 2 to 5 show partial schematic side sectional views showing a recording method wherein an embodiment of the thermal transfer material according to the present invention is used for double density recording.

Referring to FIG. 2, the thermal transfer material 1 according to the present invention comprises a support 1*a* and a heat-fusible (or heat-transferable) ink layer 1*b* disposed thereon.

Figure 1:
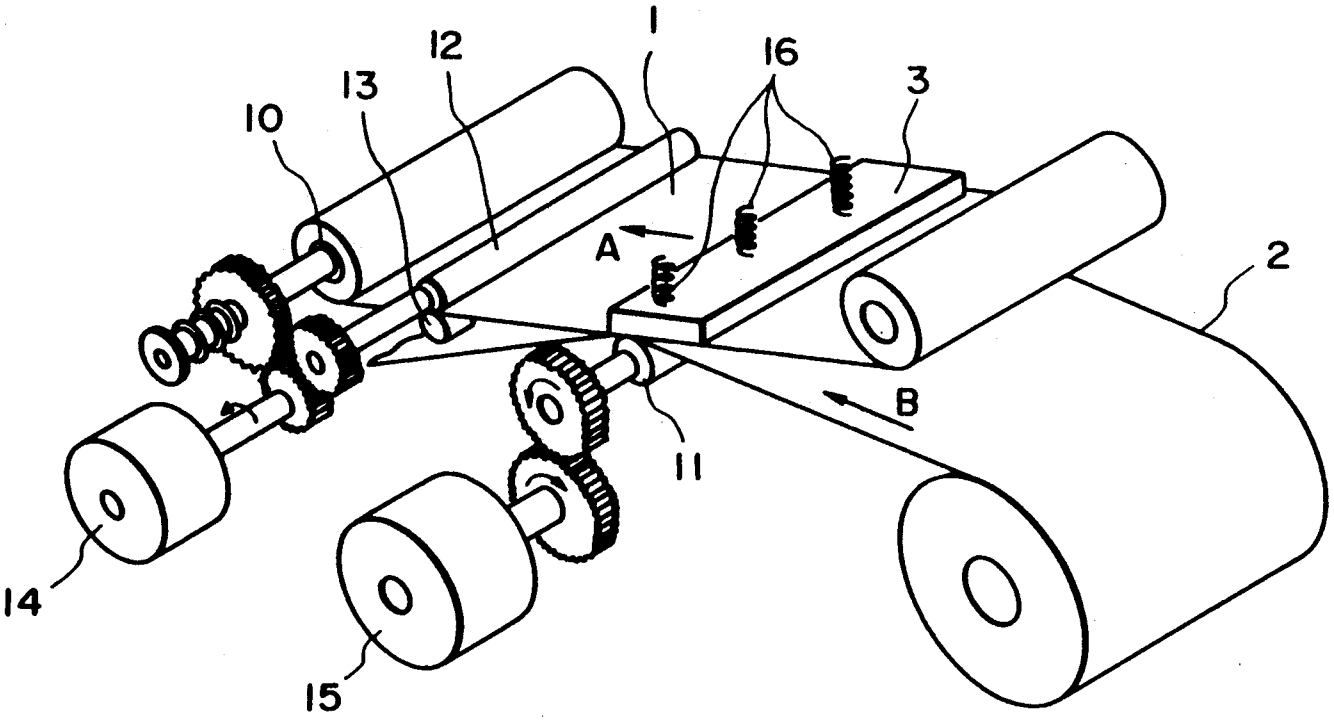
FIG. 1 is a schematic perspective view showing an apparatus for using the thermal transfer material according to the present invention.

FIG. 1 shows an apparatus for practicing an embodiment (i.e., double density recording method) of the thermal transfer recording method using the thermal transfer material according to the present invention.

Referring to FIG. 1, in such a recording method, the thermal transfer material 1 of the present invention is superposed on a recording medium (or medium to be recorded) 2 such as paper so that the heat-fusible ink layer of the thermal transfer material 1 contacts the recording medium 2, and the thermal transfer material 1 is heated by means of a recording head 3 such as thermal head, whereby the heat-fusible ink layer is transferred to the recording medium 2 to provide thereon a recorded image. The thermal transfer material 1 is moved continuously or successively in the directions of an arrow A by the rotation of a capstan roller 12 and a pinch roller 13, while the recording medium 2 is moved continuously or successively in the direction of an arrow B by the rotation of a platen roller 11, whereby recording is successively effected on the recording medium 2. In FIG. 1, the capstan roller 12 and pinch roller 13 are driven by a motor 14, and the platen roller 11 is driven by a motor 15. The thus moved thermal transfer material 1 is wound up about a winding roller 10 driven by the motor 14. A spring 16 presses the recording head 3 on the platen roller 11 by the medium of the thermal transfer material 1 and the recording medium 2.

In the embodiment as shown in FIG. 1, the thermal transfer material 1 is moved in the same direction as that of the recording medium 2. In the present invention, however, the thermal transfer material 1 may also be moved in the direction reverse to that of the recording medium 2.

In the above-mentioned thermal transfer recording method, the thermal transfer material 1 has a relative velocity with respect to the recording medium 2. In the embodiment shown in FIG. 1, the recording head 3 is not moved while the thermal transfer material 1 is moved at a speed which is lower than that of the recording medium 2. In other words, when a length corresponding to the movement of the thermal transfer material 1 in a certain period of time is compared with that corresponding to the movement of the recording medium 2 in the same period of time, the former is smaller than the latter. As a result, in the above-mentioned recording method, the recording is effected as shown by FIGS. 2 to 5.

Referring to FIG. 2, when the width of the heat-generating member (or element) 3*a* of a recording head 3 in the moving direction of the thermal transfer material 1 (i.e., in the arrow A direction) is represented by l, a first heat application is effected on the length l (i.e., a portion 21) of the thermal transfer material 1 which had not been used at all. As a result, a transferred image 31 is formed on the recording medium 2.

Figure 3:
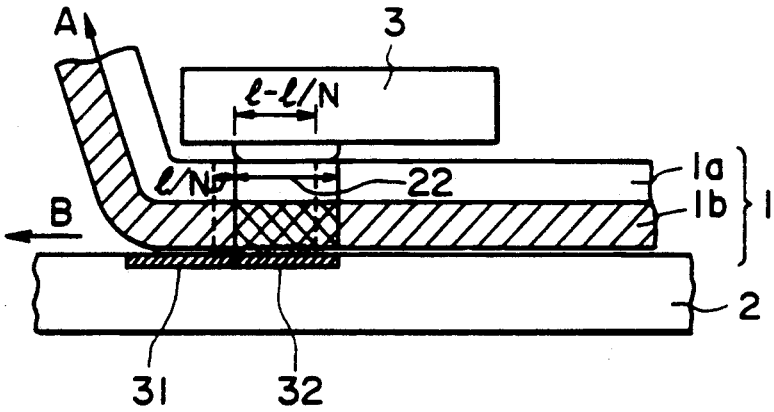

Referring to FIG. 3, at the time of second heat application, the recording medium 2 is moved through a length of l in the arrow B direction, while the thermal transfer material 1 is moved only through a length of l/N. Accordingly, a portion of the thermal transfer material 1 corresponding to the length (l−l/N), which has already been subjected to first heat application, is again used. As a result, in FIG. 3, a portion 22 of the thermal transfer material 1 is subjected to heat application, whereby a transferred image 32 is formed on the recording medium 2.

Herein, the value of "N" is a positive integer ($N \geqq 2$) representing the number of heat applications to which the same portion of the thermal transfer material 1 can be subjected. In the embodiment as shown in FIG. 2, the value of N is 5.

Figure 4:
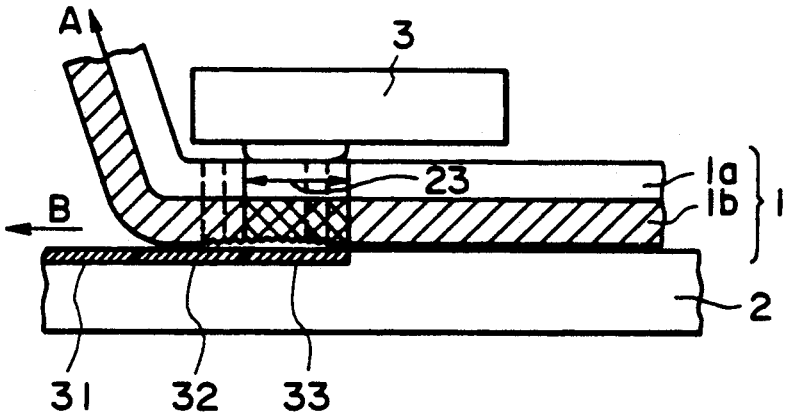
Figure 5:
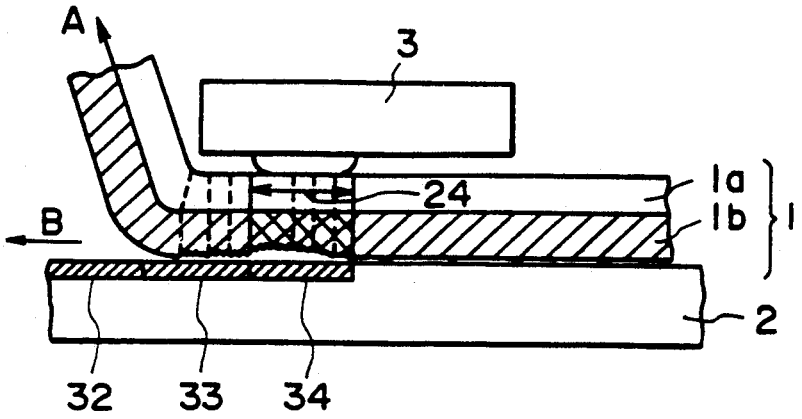

When heat applications are successively effected in such a manner along the longitudinal direction (i.e., the moving direction) of the thermal transfer material 1, at the time of heat application after the second heat application, only a portion of the thermal transfer material 1 corresponding to the length of 1/N is unused, and the other portion (at intervals of 1/N) which has already been subjected to heat application one or more times, is again subjected to heat application, as shown in FIGS. 3 to 5. More specifically, in FIG. 4, a portion 23 of the thermal transfer material 1 is subjected to heat application, whereby a transferred image 33 is formed on the recording medium 2. Further, in FIG. 5, a portion 24 of the thermal transfer material 1 is subjected to heat application, whereby a transferred image 34 is formed on the recording medium 2. In other words, the same portion of the thermal transfer material 1 is used N times, and the thermal transfer material 1 is moved while rubbing the surface of the recording medium 2.

In the above-mentioned embodiment, the thermal transfer material 1 is moved with respect to the recording head 3 at intervals of 1/N, when subjected to second and third heat applications. However, in order to reduce the consumption of the thermal transfer material 1, it is sufficient that the thermal transfer material 1 is moved at intervals each of which is smaller than 1 and not smaller than 1/N. Most effective recording may be effected when the length of travel of the thermal transfer material 1 is 1/N counted from the time of a heat application to that of the next heat application. The above-mentioned N may preferably be 2 to 10, more preferably 3 to 8.

While the recording head 3 is not moved in the above-mentioned embodiment, it is also possible to move the recording head 3. Such an embodiment may be considered in the same manner as that explained with reference to FIGS. 1 to 5, when the lengths of travel of the thermal transfer material 1 and recording medium 2 are respectively defined as those counted from the recording head 3 on the basis of the position of the recording head 3. As described above, in the thermal transfer recording method of the present invention, the length through which the thermal transfer material 1 is moved with respect to the recording head 3 in a certain period of time is smaller than the length through which the recording medium 2 is moved with respect to the recording head 3 in the same period of time.

In the above-mentioned embodiment of the present invention, since the thermal transfer material 1 is used while being rubbed with a recording medium such as paper, if the breakdown strength of the ink layer 1*b* is too low, the thermal transfer material 1 can provide ground staining on the recording medium 2 due to the friction thereof with the surface of the recording medium 2, or can provide a whisker edge portion in the resultant transferred image. If the breakdown strength of the ink layer 1*b* is too high, it becomes difficult to properly separate the ink layer 1*b* at the boundary between the heated and non-heated portions thereof. As a result, a recorded image may be produced having a poor edge-cutting property, wherein the edge portion becomes uneven or unclear (hereinafter, such an edge portion is referred to as "uneven edge portion"), or in the worst case, the ink layer cannot be cut so that it is not transferred to a recording medium.

We have investigated the relationship between the breakdown strength of an ink layer and the image quality of the resulting recorded image in double density recording, by use of various thermal transfer materials showing different breakdown strengths. As a result, we have found it very effective to set the breakdown strength of an ink layer at 25° C. to 30–80 kg/cm$^2$, preferably 35 –60 kg/cm$^2$.

The breakdown strength used herein is based on values measured by using a sample of an ink film in the form of a flat dumbbell having a uniform thickness and using a tensile tester (Tensilon RTM-100, mfd. by Toyo Boldwin K.K.) at a pulling speed of 200 mm/min., and refers to a yield strength (kg/cm$^2$) based on the thus measured data.

A flat dumbbell sample (Type-III Test Piece according to JIS K7113) is prepared in the following manner.

Inks constituting the respective ink layers in a thermal transfer material are respectively and separately applied onto a release paper by means of an applicator or wire bar and dried to form individual ink layers each having a thickness of about 35 microns. After the ink layers were dried, the release paper was removed to obtain ink layer film samples.

In the thermal transfer material according to the present invention, the ink layer may comprise a mixture of a binder and a colorant.

The binder may comprise a material having a film-forming property and capable of being thoroughly softened and/or melted under heat application. Preferred examples of such a material may include an ethylene-vinyl acetate copolymer, and an ethylene-ethyl acrylate copolymer. Among these, the ethylene-vinyl acetate copolymer is particularly preferred. In the ethylene-vinyl acetate copolymer, the copolymerization weight ratio of (ethylene):(vinyl acetate) may preferably be 90:10 to 50:50, more preferably 80:20 to 50:50. The ethylene-vinyl acetate copolymer may preferably have a softening point (ring and ball method according to JIS K 2207) of 70°–130° C., more preferably 85°–100° C. Further, the ethylene-vinyl acetate copolymer may preferably have a melt index of 150–800, more preferably 150–400. The melt index used herein may be measured by means of a measurement device (Flow Tester CFT-500, mfd. by Shimazu Seisakusho K.K.) under the following conditions:

Temperature increasing rate: 2° C./min.
Extrusion pressure: 10 kgf/cm$^2$
Die diameter: 0.5 mm, and
Die length: 1.0 mm.

In the present invention, 5–25% of the ethylene-vinyl acetate copolymer constituting the ink layer may comprise an ethylene-vinyl acetate copolymer having a vinyl acetate content of 1–13%, so that excessive ink transfer due to first heat application may be prevented in a double density recording method. In such an embodiment, the sensitivity of the ink per se is somewhat decreased, and the excess ink transfer due to the first heat application may be prevented since the adhesion of the ink under heating is also decreased. Further, at the time of second heat application, et seq., since heat is stored in the thermal transfer material, the ink film may easily be cut and the running property of the thermal transfer material may be stabilized.

When the ethylene-vinyl acetate copolymer having a vinyl acetate content of 1–13% is contained in an amount of below 5% based on the total amount of ethylene-vinyl acetate copolymer constituting the ink layer, the effect of such an ethylene-vinyl acetate copolymer is flight. When such an ethylene-vinyl acetate copolymer is contained in an amount greater than 25%, the film-forming property of the ink layer may be decreased and ground staining and whisker edge portion tailing are undesirably liable to occur.

On the other hand, in the above-mentioned ethylene-ethyl acrylate copolymer, the copolymerization ratio of (ethylene):(ethyl acetate) may preferably be 90:10 to 65:35, and the softening point (ring and ball method) thereof may preferably be 70°–130° C., more preferably 85°–100° C.

When most of the binder comprises the ethylene-vinyl acetate copolymer or ethylene-ethyl acetate copolymer, the melt viscosity is increased and the breakdown strength of the ink layer becomes higher. Accordingly, in order to adjust the melt viscosity and/or breakdown strength of the ink layer, a wax may be mixed in the binder.

Such a wax may comprise one or more species selected from: natural waxes such as carnauba wax, montan wax, and linol wax; synthetic waxes such as paraffin wax, microcrystalline wax, castor wax, polyethylene wax, and Sasol wax; acid wax, ester wax, polyethylene wax, polypropylene wax, etc.

In the binder, the ethylene-vinyl acetate copolymer (or ethylene-ethyl acrylate copolymer) content may preferably be 40–80%, more preferably 45–70% based on the binder. Further, the wax content may preferably be 20–60%, more preferably 25–50%.

The binder may contain a tackifier as a binder component so that the ink layer may strongly adhere to a recording medium.

In an embodiment wherein a tackifier is contained in the binder, the following effect may be achieved.

For example, when printing is effected so as to provide an image corresponding to a so-called "No. 8 Test Chart" of THE INSTITUTE OF IMAGE ELECTRONICS ENGINEERS OF JAPAN (hereinafter, simply referred to "No. 8 Test Chart"), e.g., by reading such a chart by use of an image scanner and outputting the resultant image through a thermal transfer printer, white streaks can sometimes occur in a white letter portion disposed in a solid black image portion, or the image density of a solid black image portion can be ununiform in some cases.

According to our investigation, such a phenomenon is attributable to instability in running of a thermal transfer material. The reason for the instability in the running of the thermal transfer material may be considered that the contact area between the thermal transfer material and a recording medium is changed in the printing of a solid black image portion at the time of movement of from the solid black portion to the white image portion disposed therein, and at the time of movement of from the white image portion to the solid black portion, whereby the load applied to a means for conveying the thermal transfer material is considerably changed at these times.

When we have investigated a thermal transfer material capable of preventing such a phenomenon, we have found that the above-mentioned phenomena closely relate to the compatibility of binder components constituting an ink.

In the present invention, the ethylene-vinyl acetate copolymer and wax constituting the binder component of the ink layer may have a good compatibility with each other. However, changes arising with the elapse of time during storage, etc., cause the wax component to be separated from another component, and the ink layer can be separated into an ink layer portion rich in the wax, and an ink layer portion rich in the ethylene-vinyl acetate copolymer, in some cases. Therefore, in order to further enhance the compatibility between the wax and the ethylene-vinyl acetate copolymer and to stably retain the compatibility therebetween even with change with the elapse of time, it is very effective to add a tackifier to these components. Further, such a tackifier is also effective in preventing ground staining on the basis of an improvement in compatibility. In order to achieve such an effect, it is preferred to add the tackifier to the binder in an amount of 5–15%, more preferably 7–12% based on the total weight of the binder (inclusive of the tackifier per se).

When the addition amount of the tackifier is below 5%, the compatibility is a little enhanced. When the addition amount of the tackifier exceeds 15%, the melt viscosity and the tackiness under heating are increased, whereby the running property of the thermal transfer material undesirably becomes unstable.

The tackifier to be added, may preferably have a softening point (according to ring and ball method) of 70°–110° C., more preferably 80°–100° C. When the softening point is below 70° C., the tackifier may have a tackiness at room temperature, and may be problematic in storage., When the softening point exceeds 110° C., an undesirable increase in printing energy results.

The tackifier to be added may preferably have a melt viscosity of $2\times10^2$–$3\times10^4$ mPa.s, more preferably $4\times10^2$–$1.5\times10^4$ mPa.s, at 140° C. The melt viscosity used herein may be measured by means of a rotation viscometer (Rotovisco PK-I-0.3, mfd. by Haake Co.). While the melt viscosity of the tackifier relates to those of the wax and/or ethylene-vinyl acetate copolymer as the other components constituting the binder, the above-mentioned range of the melt viscosity is preferred because of the compatibility between these components. Further, in order to prevent considerable change in melt viscosity, the above-mentioned range of melt viscosity is preferred. The tackifier may preferably have a number-average molecular weight of 200–2000.

The tackifier may preferably be one or more species selected from: coumarone-indene resins, phenolformaldehyde resins, polyterpene resins, xyleneformaldehyde resins, polybutene, rosin pentaerythritol ester, rosin glycerin ester, hydrogenated rosin, hydrogenated rosin methyl ester, hydrogenated rosin ethylene glycol ester, hydrogenated rosin pentaerythritol ester, polymerized rosin ester such as polymerized rosin polyhydric alcohol ester (e.g., polymerized rosin pentaerythritol ester), aliphatic petroleum resin, alicyclic petroleum resin, synthetic polyterpene, pentadiene resin, etc. These materials may be used alone or as a mixture of two or more species thereof.

In the present invention, the tackifier may particularly preferably comprise an aliphatic hydrocarbon resin and/or an aromatic hydrocarbon resin. The aliphatic hydrocarbon resin and aromatic hydrocarbon resin may have a narrower molecular weight distribution, and may show a sharper heat-melting property and a paler color as compared with another tackifier. Accordingly, these hydrocarbon resins do not impair the color of a colorant, and are thermally stable without an odor.

In a preferred embodiment of the present invention, the binder comprises 40–70% of an ethylene-vinyl acetate copolymer, 25–50% of a wax, and 7–12% of a tackifier. It is preferred to disperse a colorant in such a binder so that the resultant ink layer may provide a breakdown strength of 30–80 kg/cm$^2$ at 25° C. In the present invention, the breakdown strength of the ink layer may be increased by increasing the ethylene-vinyl acetate content.

In the present invention, various dyes or pigments may be used as the colorant. Specific examples of such colorant may include one or more of known dyes or pigments such as carbon black, Nigrosine dyes, lamp black, Sudan Black SM, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 2G, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zapon Fast Yellow CGG, Kayaset Y963, Smiplast Yellow GG, Zapon Fast Orange RR, Oil Scarlet, Smiplast Orange G, Orazole Brown G, Zapon Fast Scarlet CG, Aizen Spiron Red F4R, Fastgen Blue 5007, Sudan Blue, and Oil Peacock Blue.

The colorant may preferably be contained in the ink layer in an amount of 1–50%, more preferably 5–35%, based on the total weight of the ink layer. If the the colorant content is smaller than 1%, the image density of a recorded image becomes low. On the other hand, if the colorant content exceeds 50%, there can occur undesirable problems such as increase in recording energy and decrease in the transferability of the ink layer.

As the support or base material 1*a*, known plastic films or papers may be used. In the double density recording, however, since the same portion of the thermal transfer material is supplied with heat plural times as explained hereinabove, a support having high heat resistance such as aromatic polyamide film, polyphenylene sulfide film, polyether ether ketone, and capacitor paper may preferably be used. When there is used a polyester film (particularly, a polyethylene terephthalate film, i.e., PET film) which has suitably been used for thermal transfer materials conventionally, it is preferred to dispose a layer of a heat-resistant and/or lubricating material as a back coating layer, on the surface of the film to be heated (i.e., the surface of the film 1*a* which is reverse to the surface thereof provided with the ink layer 1*b*).

The support 1*a* may preferably have a thickness of 3–20 microns, more preferably 4–12 microns. If a sufficient heat resistance and a strength are attained, a support can be thinner than 3 microns. Too thick a support is not desirable because the heat conductivity becomes inferior. However, such a criterion is not applicable to an embodiment (i.e., electric conduction transfer recording method) wherein an electroconductive support is used for a thermal transfer material; a head comprising an electrode stylus is used instead of the thermal head; and a voltage is applied to the thermal transfer material to generate Joule's heat so that recording is effected.

The thickness of the ink layer may preferably be 10–30 g/m$^2$, more preferably 15–30 g/m$^2$, particularly 16–25 g/m$^2$, in terms of coating weight after drying. When the thickness of the ink layer is below 10 g/m$^2$, a sufficient recording density cannot be obtained in double density recording. When the thickness exceeds 30 g/m$^2$, there undesirably occur problems such as curl of the thermal transfer material and increase in recording energy.

Figure 7:
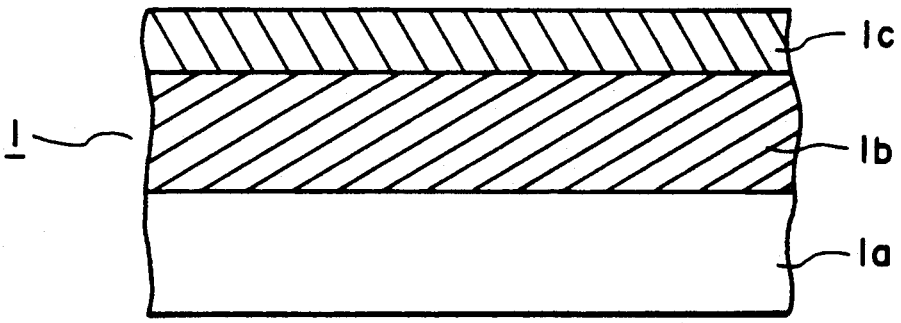
FIG. 7 is a partial schematic sectional view showing another embodiment of the thermal transfer material according to the present invention.

The thermal transfer material according to the present invention can further comprise a second ink layer 1*c* disposed on a first ink layer 1*b* as shown in FIG. 7, so that the entire ink layer disposed on a support 1*a* has a multi-layer structure. The first ink layer 1*b* shown in FIG. 7 may be the same as the ink layer 1*b* shown in FIG. 2.

The second ink layer 1*c* disposed on the first ink layer 1*b* is effective in decreasing the friction between the thermal transfer material 1 and a recording medium, when the former is rubbed with the latter. The second ink layer 1*c* may preferably comprise a so-called "wax" such as carnauba wax, montan wax, polyethylene wax, and paraffin wax. When the material constituting the second ink layer 1*c* is selected from these materials, the softening point (ring and ball method) of the second ink layer 1*c* may preferably be 60°–100° C., more preferably 70–85° C. The reason for this is that the second ink layer 1*c* having such a softening point does not substantially prevent the transfer of the first ink layer 1*b* melted under heat application, while the second ink layer 1*c* is disposed at a longest distance from a thermal head.

At the time of recording, a heat-applied portion of the second ink layer 1*c* may preferably be transferred to a recording medium together with the first ink layer 1*b*, and a non-heat-applied portion thereof may preferably have a function of stabilizing the running property of the thermal transfer material 1 due to the lubricating property thereof. Accordingly, it is preferred that the second ink layer 1*c* contain substantially no colorant. However, when a colorant is contained in the second ink layer 1*c* in view of image density, etc., the weight ratio of (colorant content of the second ink layer 1*c*)/(colorant content of the first ink layer 1*b*) may preferably be ½ or smaller, more preferably 1/5 or smaller.

The second ink layer 1*c* may preferably have a thickness as small as possible, more specifically, preferably 0.1–8 microns, more preferably 0.5–5 microns. When the thickness of the second ink layer 1*c* is below 0.1 micron, the running property is only slightly improved. When the thickness exceeds 5 microns, the transferability of the first ink layer 1*c* may undesirably be decreased.

In the present invention, the entirety of the ink layer disposed on the support 1*a* may preferably has a melt viscosity of $3\times10^3$–$5\times10^4$ mPa.s, more preferably $7\times10^3$–$4\times10^4$ mPa.s, at 120° C. When the melt viscosity of the ink layer is too low, a large amount of the ink is transferred to a recording medium at the time of first heat application, and only a small amount of the ink is transferred thereto at the time of second heat application, et seq., in double density recording. Accordingly, the image density of a recorded image can be decreased, or the image density can be uneven in some cases. On the other hand, when the melt viscosity of the ink layer is too high, the ink layer is not cut but is bonded to a recording medium after the former contacts the latter, whereby running failure undesirably occurs.

In a thermal transfer material suitable for double density recording, the ink layer is required to have a larger thickness than that used in the conventional thermal transfer material, and this is disadvantageous in view of heat energy needed. Accordingly, the melting point of the ink may preferably be 60°–100° C., more preferably 65°–85° C. according to differential scanning calorimeter (DSC) measurement. In order to provide such a melting point, it is preferred to select a wax component having a melting point of about 60°–100° C., more preferably about 65°–85° C. according to DSC measurement.

The melting point used herein may be measured by means of a differential scanning calorimeter (trade name: DSC-7) at a temperature increasing rate of 10° C./min. The temperature corresponding to the resultant endothermic peak is defined as the above-mentioned melting point.

When the melting point is below 60° C., the thermal transfer material becomes problematic in storability. When the melting point exceeds 100° C., a problem such as increase in printing energy occurs.

The thermal transfer material of the present invention may be obtained in the following manner.

For example, the binder which has been selected in consideration of the above-mentioned viewpoint is dissolved in an organic solvent such as toluene, methyl ethyl ketone, isopropyl alcohol, methanol and xylene, a colorant is then mixed in the resultant solution and sufficiently dispersed by means of a dispersing machine such as a sand mill, and the thus obtained coating liquid is applied onto a support by a coating method such as bar coating and gravure coating. Alternatively, the binder is heated up to a temperature above the softening point thereof, a colorant is dispersed or dissolved therein and the resultant mixture is applied onto a support by a so-called hot-melt coating. Further, the binder and colorant may be formed into an aqueous emulsion by the addition of a dispersant such as surfactant, and the aqueous emulsion may be applied onto a support (or another ink layer) to form an ink layer. When the ink layer has a multi-layer structure, the layers may respectively be formed by coating methods as described above.

At the time of the application of an ink to a support, when a colored ink having a mono-color (e.g., black color) is applied onto the entire surface of the support, a mono-color thermal transfer material may be obtained. Alternatively, inks having plural colors (e.g., two or more species selected from cyan ink, magenta ink, yellow ink, blue ink, green ink, red ink, etc.) may be applied onto a support repetitively so that ink layers of plural colors may be formed on the support at prescribed intervals with respect to the longitudinal direction or width direction of the support, whereby a thermal transfer material for multi-color recording may be obtained. Multi-color recording may be effected by using such a thermal transfer material so that prescribed colors are superposed on a recording medium.

Hereinbelow, the present invention will be explained more specifically while referring to specific examples of practice.

EXAMPLE 1

| | |
|---|---|
| Polymerized rosin pentaerythritol ester (softening point (ring and ball method) = 85° C.) | 7.5 wt. parts |
| Ester wax (Hoechst Wax E, mfd. by Hoechst, melting point (DSC) = 79-85° C., acid value = 15-20, saponification value = 130-160) | 29 wt. parts |
| Ethylene-vinyl acetate copolymer (Evaflex 410, mfd. by Mitsui Du Pont Polychemical K.K., vinyl acetate content = 19%, softening point (ring and ball method) = 90° C.) | 48.5 wt. parts |
| Carbon black (MA-11, mfd. by Mitsubishi Kasei K.K.) | 15 wt. parts |
| Toluene | 900 wt. parts |

The above materials were mixed by means of a ball mill, and the resultant coating liquid was applied onto a PET film having a thickness of 6 microns and a width of 260 mm by means of a wire bar (count of the wire bar = #60) to form an ink layer having a coating amount of 20 g/m$^2$ after drying, whereby a thermal transfer material according to the present invention was obtained.

The PET film used herein was one wherein the surface thereof reverse to that to be provided with the ink layer had preliminarily been coated with a back coating material comprising a ternary copolymer of silicone-acryl-urethane in a coating amount (after drying) of 0.3 g/m$^2$.

The film strength of the resultant ink layer was measured as described hereinabove. The results are shown in Table 1 appearing hereinafter.

Separately, a facsimile machine for double density recording (as a machine for evaluation) was obtained by partially modifying a commercially available facsimile machine (trade name: Canofax 630, mfd. by Canon K.K.). In the resultant machine, mechanical and physical conditions were as follows:

(1) A full-multi (i.e., line-type) thermal head of 8 pel/mm was assembled and was fixed so that it exerted a pressure of 1 kg/cm$^2$ on a platen roller.

(2) The feed amount of a thermal transfer material was about 1/5 times that of a recording medium.

(3) The moving direction of the thermal transfer material was reverse to that of the recording medium.

(4) The printing speed on the recording medium was 25 mm/sec. At this time, the thermal transfer material had a relative velocity of 31.2 mm/sec with respect to the recording medium.

(5) The thermal head was energized so that it generated heat energy of 22 mJ/mm$^2$ at the surface thereof.

Then, the above-mentioned thermal transfer material was loaded on the thus modified machine and evaluated by forming recorded images on a recording paper.

The results are shown in Table 1 appearing hereinafter.

EXAMPLES 2-13

| | |
|---|---|
| <Example 2> | |
| Polymerized rosin pentaerythritol ester | 3.5 wt. parts |

-continued

| | |
|---|---|
| (the same as in Example 1) | |
| Ester wax (the same as in Example 1) | 21.7 wt. parts |
| Ethylene-vinyl acetate copolymer (the same as in Example 1) | 61.7 wt. parts |
| Carbon black (the same as in Example 1) | 13.1 wt. parts |
| Toluene | 900 wt. parts |
| <Example 3> | |
| Polymerized rosin pentaerythritol ester (the same as in Example 1) | 10.4 wt. parts |
| Ester wax (the same as in Example 1) | 41.7 wt. parts |
| Ethylene-vinyl acetate copolymer (the same as in Example 1) | 34.8 wt. parts |
| Carbon black (the same as in Example 1) | 13.1 wt. parts |
| Toluene | 900 wt. parts |
| <Example 4> | |
| Aliphatic petroleum resin (Quinton TB-51, mfd. by Nihon Zeon K.K., softening point = 95° C.) | 4.3 wt. parts |
| Montan wax (Hoechst Wax U, mfd. by Hoechst, melting point (DSC) = 82-88° C., acid value = 79-92, saponification value = 110-135) | 26.1 wt. parts |
| Ethylene-vinyl acetate copolymer (Evaflex 220, mfd. by Mitsui Du Pont Polychemical K.K., vinyl acetate content = 28%, softening point (ring and ball method) = 90° C.) | 56.5 wt. parts |
| Carbon black (the same as in Example 1) | 13.1 wt. parts |
| Toluene | 900 wt. parts |
| <Example 5> | |
| Synthetic terpene resin (Tack-Ace A100, mfd. by Mitsui Sekiyu Kagaku K.K., softening point (ring and ball method) = 100° C., molecular weight = 650-850) | 4.3 wt. parts |
| Acid wax (Hoechst Wax S, mfd. by Hoechst, melting point (DSC) = 81-87° C., acid value = 131-155, saponification value = 155-175) | 30.4 wt. parts |
| Ethylene-vinyl acetate copolymer (the same as in Example 4) | 52.1 wt. parts |
| Carbon black (the same as in Example 1) | 13.2 wt. parts |
| Toluene | 900 wt. parts |
| <Example 6> | |
| Rosin glycerin ester (Hariester L. mfd. by Harima Kasei K.K., softening point = 80-90° C., acid value = 4-8) | 8.7 wt. parts |
| Carnauba wax (Carnauba No. 1, mfd. by Kato Yoko K.K., melting point = 83° C., acid value = 2-6, saponification value = 78-88) | 34.8 wt. parts |
| Ethylene-vinyl acetate copolymer (MB-010, mfd. by Nippon Unicar K.K., vinyl acetate content = 25%) | 52.1 wt. parts |
| Carbon black (the same as in Example 1) | 13.1 wt. parts |
| Toluene | 900 wt. parts |
| <Example 7> | |
| Polyterpene (YS-Polyester T-80, mfd. by Yasuhara Yushi K.K., softening point = 80° C.) | 7 wt. parts |
| Carnauba wax (the same as in Example 6) | 34.8 wt. parts |
| Ethylene-vinyl acetate copolymer (the same as in Example 6) | 45.2 wt. parts |
| Carbon black (the same as in Example 1) | 13 wt. parts |
| Toluene | 900 wt. parts |
| <Example 8> | |
| Rosin glycerin ester (the same as in Example 6) | 8.7 wt. parts |
| Paraffin wax (Paraffin wax 155, mfd. by Nihon Seiro K.K., | 21.7 wt. parts |

-continued

| | |
|---|---|
| melting point = 69° C.) | |
| Ethylene-vinyl acetate copolymer (the same as in Example 1) | 56.5 wt. parts |
| Carbon black (the same as in Example 1) | 13.1 wt. parts |
| Toluene | 900 wt. parts |
| <Example 9> | |
| Polymerized rosin pentaerythritol ester (the same as in Example 1) | 6.1 wt. parts |
| Microcrystalline wax (Hi-Mic 1080, mfd. by Nihon Seiro K.K., melting point = 84° C.) | 26.1 wt. parts |
| Ethylene-ethyl acrylate copolymer (A-702, mfd. by Mitsui Du Pont Polychemical, ethyl acrylate content = 19%, Vicat softening point (JIS K 6739) = 100° C.) | 54.8 wt. parts |
| Carbon black (the same as in Example 1) | 13 wt. parts |
| Toluene | 900 wt. parts |
| <Example 10> | |
| Polymerized rosin pentaerythritol ester (the same as in Example 1) | 6.1 wt. parts |
| Lanolin wax (FP-1410N, mfd. by Yoshikawa Seiyu K.K., melting point = 70° C.) | 26.1 wt. parts |
| Ethylene-vinyl acetate copolymer (the same as in Example 1) | 54.8 wt. parts |
| Carbon black (the same as in Example 1) | 13 wt. parts |
| Toluene | 900 wt. parts |
| <Example 11> | |
| Ester wax (the same as in Example 1) | 45 wt. parts |
| Ethylene-vinyl acetate copolymer (the same as in Example 1) | 40 wt. parts |
| Carbon black (the same as in Example 1) | 15 wt. parts |
| Toluene | 900 wt. parts |
| <Example 12> | |
| Polymerized rosin pentaerythritol ester (the same as in Example 1) | 2.6 wt. parts |
| Ester wax (the same as in Example 1) | 24.3 wt. parts |
| Ethylene-vinyl acetate copolymer (the same as in Example 1) | 60 wt. parts |
| Carbon black (the same as in Example 1) | 13.1 wt. parts |
| Toluene | 900 wt. parts |
| <Example 13> | |
| Polymerized rosin pentaerythritol ester (the same as in Example 1) | 11.3 wt. parts |
| Ester wax (the same as in Example 1) | 24.3 wt. parts |
| Ethylene-vinyl acetate copolymer (the same as in Example 1) | 51.3 wt. parts |
| Carbon black (the same as in Example 1) | 13.1 wt. parts |
| Toluene | 900 wt. parts |

The materials corresponding to the above-mentioned Examples 2–13 were respectively mixed to prepare 12 species of coating liquids, and 12 species of thermal transfer materials were prepared by using Example 1.

The film strength of the resultant ink layers were measured. The results are shown in Table 1 appearing hereinafter.

Each of the above-mentioned thermal transfer materials of Examples 2–13 was evaluated by forming recorded images on recording paper in the same manner as in Example 1.

The evaluation results are shown in Table 1 appearing hereinafter.

COMPARATIVE EXAMPLES 1–6

| | |
|---|---|
| <Comparative Example 1> | |
| Polymerized rosin pentaerythritol ester (the same as in Example 1) | 5.2 wt. parts |
| Ester wax (the same as in Example 1) | 15.4 wt. parts |
| Ethylene-vinyl acetate copolymer (the same as in Example 1) | 60.9 wt. parts |
| Carbon black (the same as in Example 1) | 13 wt. parts |
| Toluene | 900 wt. parts |
| <Comparative Example 2> | |
| Polymerized rosin pentaerythritol ester (the same as in Example 1) | 5.2 wt. parts |
| Ester wax (the same as in Example 1) | 55.6 wt. parts |
| Ethylene-vinyl acetate copolymer (the same as in Example 1) | 39.1 wt. parts |
| Carbon black (the same as in Example 1) | 13.1 wt. parts |
| Toluene | 900 wt. parts |
| <Comparative Example 3> | |
| Polymerized rosin pentaerythritol ester (the same as in Example 1) | 8.7 wt. parts |
| Ester wax (the same as in Example 1) | 44.3 wt. parts |
| Ethylene-vinyl acetate copolymer (the same as in Example 1) | 33.9 wt. parts |
| Carbon black (the same as in Example 1) | 13.1 wt. parts |
| Toluene | 900 wt. parts |
| <Comparative Example 4> | |
| Polymerized rosin pentaerythritol ester (the same as in Example 1) | 3.5 wt. parts |
| Ester wax (the same as in Example 1) | 20.9 wt. parts |
| Ethylene-vinyl acetate copolymer (the same as in Example 1) | 72.6 wt. parts |
| Carbon black (the same as in Example 1) | 13 wt. parts |
| Toluene | 900 wt. parts |
| <Comparative Example 5> | |
| Polymerized rosin pentaerythritol ester (the same as in Example 1) | 12 wt. parts |
| Ethylene-vinyl acetate copolymer (the same as in Example 1) | 71 wt. parts |
| Carbon black (the same as in Example 1) | 17 wt. parts |
| Toluene | 900 wt. parts |
| <Comparative Example 6> | |
| Polymerized rosin pentaerythritol ester (the same as in Example 1) | 12 wt. parts |
| Ester wax (the same as in Example 1) | 71 wt. parts |
| Carbon black (the same as in Example 1) | 17 wt. parts |
| Toluene | 900 wt. parts |

The materials corresponding to the above-mentioned Comparative Examples 1–6 were respectively mixed to prepare 6 species of coating liquids) and 6 species of thermal transfer materials were prepared by using the resultant coating liquids in the same manner as in Example 1.

The film strength of the resultant ink layers were measured. The results are shown in Table 1 appearing hereinafter.

Each of the above-mentioned thermal transfer materials of Comparative Examples 1–6 was evaluated by forming recorded images on recording paper in the same manner as in Example 1.

The results are shown in Table 1 appearing hereinafter.

TABLE 1

| | | Breakdown strength (kg/cm²) | Ground staining | Whisker edge portion | Unevenness in edge portion |
|---|---|---|---|---|---|
| Example | 1 | 49 | ◎ | ○ | ○ |
| | 2 | 80 | ◎ | ○ | Δ |
| | 3 | 35 | ◎ | ○ | ○ |
| | 4 | 55 | ◎ | ○ | ○ |
| | 5 | 45 | ◎ | ○ | ○ |
| | 6 | 44 | ◎ | ○ | ○ |
| | 7 | 30 | ○ | ○ | ○ |
| | 8 | 60 | ◎ | ○ | ○ |
| | 9 | 49 | ◎ | ○ | ○ |
| | 10 | 50 | ◎ | ○ | ○ |
| | 11 | 45 | ◎ | ○ | ○ |
| | 12 | 45 | ◎ | ○ | ○ |
| | 13 | 40 | ◎ | ○ | ○ |
| Comp. Example | 1 | 85 | ◎ | ○ | x |
| | 2 | 15 | x | x | ○ |
| | 3 | 10 | x | x | ○ |
| | 4 | 95 | ◎ | ○ | x |
| | 5 | 98 | ◎ | ○ | x |
| | 6 | 5 | x | x | ○ |

(1) With respect to the above-mentioned breakdown strength, the measurement was repeated three times and the resultant values were averaged.

(2) With respect to the above ground staining, whisker edge portion and unevenness in edge portion, the symbols respectively have the following meanings.

Ground Staining

The reflection image density of a non-image portion of the recording medium was measured by means of a densitometer (Model: MR-100, mfd. by Macbeth Co.).

◎: The reflection density was 0–0.05 (i.e., substantially the same as the reflection density of an original portion of the recording medium).

○: The reflection density was larger than 0.05 and not larger than 0.08 (i.e., the recording medium was slightly stained but was not problematic in practice).

x : The reflection was larger than 0.08 (i.e., the recording medium was considerably stained).

Whisker edge portion

Figure 6:
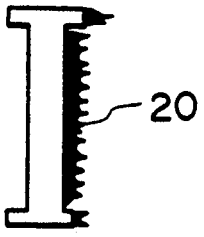
FIG. 6 is a schematic plan view of a recorded image provided by a conventional thermal transfer material.

A letter "I" as shown in FIG. 6 was observed by using a magnifying lens (magnification: ×10).

○: Transfer in the form of whiskers did not substantially occur.

x : Transfer in the form of whiskers considerably occurred.

Unevenness in edge portion

A letter "I" was observed in the same manner as described above.

○: The edge portion of the recorded image was clear and unevenness therein was not substantially observed.

Δ: The edge portion of the recorded image slightly became uneven but was not problematic in practice.

x : The edge portion of the recorded image noticiably became uneven and was not usable in practice.

EXAMPLE 14

| | |
|---|---|
| Montanic acid ester wax (Hoechst Wax E, melting point (DSC) = 79–85° C.) | 34.0 wt. parts |
| Ethylene-vinyl acetate copolymer (Evaflex 220, mfd. by Mitsui Du Pont Polychemical K.K., vinyl acetate content = 28%, softening point (ring and ball method) = 90° C.) | 42.5 wt. parts |
| Aliphatic hydrocarbon resin (Piccotac B-BHT, mfd. by Hercules Co., softening point (ring and ball method) = 100° C., melt viscosity at 140° C. = 4 × 10³ mPa.s) | 8.5 wt. parts |
| Carbon black (MA-11, mfd. by Mitsubishi Kasei K.K., particle size = 29 mμ, oil absorption (DBP-ml/100 g) = 65, pH = 3.2*) | 15.0 wt. parts |
| Toluene | 400 wt. parts |

*: When the carbon black was dispersed in water, it showed a pH value of 3.2.

The above components other than the carbon black were dissolved in the toluene under heating, and then the carbon black was added thereto, and the resultant mixture was dispersed by means of a sand mill at 2000 rpm for 30 min., thereby to prepare an ink.

Separately, a PET film having a thickness of 6 microns and a width of 260 mm was coated with a back coating material comprising a ternary copolymer of silicone-acryl-urethane in a coating amount of 0.8 g/m².

The above-mentioned ink was applied onto the surface of the PET film, which was reverse to that provided with the back coating, by means of a wire bar, and dried for 1 min. in a drying oven heated up to 100° C., whereby a thermal transfer material having an ink layer (coating amount after drying = 15 g/m²) was obtained.

In this instance, the breakdown strength of the resultant ink layer was 53 kg/cm² at 25° C. which was an average value of three values obtained from three measurements (the same as in the breakdown strengths appearing hereinafter).

EXAMPLE 15

| | |
|---|---|
| Montanic acid ester wax (Hoechst Wax E, mfd. by Hoechst, melting point (DSC) = 79–85° C.) | 35.3 wt. parts |
| Ethylene-vinyl acetate copolymer (Evaflex 220, mfd. by Mitsui Du Pont Polychemical K.K., vinyl acetate content = 28%, softening point (ring and ball method) = 90° C.) | 44.2 wt. parts |
| Aliphatic hydrocarbon resin (Piccotac B-BHT, mfd. by Hercules Co., softening point (ring and ball method) = 100° C., melt viscosity at 140° C. = 4 × 10³ mPa.s) | 5.5 wt. parts |
| Carbon black (MA-11, mfd. by Mitsubishi Kasei K.K., particle size = 29 mμ, oil absorption (DBP-ml/100 g) = 65, pH = 3.2) | 15.0 wt. parts |
| Toluene | 400 wt. parts |

The above components other than the carbon black were dissolved in the toluene under heating, then the carbon black was added thereto, and the resultant mixture was dispersed by means of a sand mill at 2000 rpm for 30 min., thereby to prepare an ink.

Separately, a PET film having a thickness of 6 microns was coated with a back coating material in the same manner as in Example 14. The above-mentioned ink was applied onto the surface of the PET film, which was reverse to that provided with the back coating, by means of a wire bar, and dried for 1 min. in a drying oven heated up to 100° C., whereby a thermal transfer material having an ink layer (coating amount after drying=15 g/m$^2$) was obtained. In this instance, the breakdown strength of the resultant ink layer was 55 kg/cm$^2$ at 25° C.

EXAMPLE 16

| | |
|---|---|
| Montanic acid ester wax (Hoechst Wax E, mfd. by Hoechst, melting point (DSC) = 79-85° C.) | 32.4 wt. parts |
| Ethylene-vinyl acetate copolymer (Evaflex 220, mfd. by Mitsui Du Pont Polychemical K.K., vinyl acetate content = 28%, softening point (ring and ball method) = 90° C.) | 40.6 wt. parts |
| Aliphatic hydrocarbon resin (Piccotac B-BHT, mfd. by Hercules Co., softening point (ring and ball method) = 100° C., melt viscosity at 140° C. = 4 × 10$^3$ mPa.s) | 12.0 wt. parts |
| Carbon black (MA-11, mfd. by Mitsubishi Kasei K.K., particle size = 29 mμ, oil absorption (DBP-ml/100 g) = 65, pH = 3.2) | 15.0 wt. parts |
| Toluene | 400 wt. parts |

The above components other than the carbon black were dissolved in toluene under heating, then the carbon black was added thereto, and the resultant mixture was dispersed by means of a sand mill at 2000 rpm for 30 min., thereby to prepare an ink.

Separately, a PET film having a thickness of 6 microns was coated with a back coating material in the same manner as in Example 14.

The above-mentioned ink was applied onto the surface of the PET film, which was reverse to that provided with the back coating, by means of a wire bar, and dried for 1 min. in a drying oven heated up to 100° C., whereby a thermal transfer material having an ink layer (coating amount after drying=15 g/m$^2$) was obtained.

In this instance, the breakdown strength of the resultant ink layer was 48 kg/cm$^2$ at 25° C.

EXAMPLE 17

| | |
|---|---|
| Montanic acid ester wax (Hoechst Wax E, mfd. by Hoechst, melting point (DSC) = 79-85° C.) | 34.0 wt. parts |
| Ethylene-vinyl acetate copolymer (Evaflex 220, mfd. by Mitsui Du Pont Polychemical K.K., vinyl acetate content = 28%, softening point (ring and ball method) = 90° C.) | 42.5 wt. parts |
| Aromatic hydrocarbon resin (Oligotec 1300, mfd. by Mitsuibishi Sekiyu K.K., softening point (ring and ball method) = 95° C., melt viscosity at 140° C. = 9 × 10$^2$ mPa.s) | 8.5 wt. parts |
| Carbon black (MA-11, mfd. by Mitsubishi Kasei K.K., particle size = 29 mμ, oil absorption (DBP-ml/100 g) = 65, pH = 3.2) | 15.0 wt. parts |
| Toluene | 400 wt. parts |

The above components other than the carbon black were dissolved in toluene under heating, then the carbon black was added thereto, and the resultant mixture was dispersed by means of a sand mill at 2000 rpm for 30 min., thereby to prepare an ink. Separately, a PET film having a thickness of 6 microns was coated with a back coating material in the same manner as in Example 14. The above-mentioned ink was applied onto the surface of the PET film, which was reverse to that provided with the back coating, by means of a wire bar, and dried for 1 min. in a dry oven heated up to 100° C., whereby a thermal transfer material having an ink layer (coating amount after drying=15 g/m$^2$) was obtained. In this instance, the breakdown strength of the resultant ink layer was 50 kg/cm$^2$ at 25° C.

COMPARATIVE EXAMPLE 7

| | |
|---|---|
| Montanic acid ester wax (Hoechst Wax E, mfd. by Hoechst, melting point (DSC) = 79-85° C.) | 7.5 wt. parts |
| Ethylene-vinyl acetate copolymer (Evaflex 220, mfd. by Mitsui Du Pont Polychemical K.K., vinyl acetate content = 28%, softening point (ring and ball method) = 90° C.) | 69.0 wt. parts |
| Aliphatic hydrocarbon resin (Piccotac B-BHT, mfd. by Hercules Co., softening point (ring and ball method) = 100° C., melt viscosity at 140° C. = 4 × 10$^3$ mPa.s) | 8.5 wt. parts |
| Carbon black (MA-11, mfd. by Mitsubishi Kasei K.K., particle size = 29 mμ, pH = 3.2) | 15.0 wt. parts |
| Toluene | 400 wt. parts |

The above components other than the carbon black were dissolved in toluene under heating, then the carbon black was added thereto, and the resultant mixture was dispersed by means of a sand mill at 2000 rpm for 30 min., thereby to prepare an ink.

Separately, a PET film having a thickness of 6 microns was coated with a back coating material in the same manner as in Example 14.

The above-mentioned ink was applied onto the surface of the PET film, which was reverse to that provided with the back coating, by means of a wire bar, and dried for 1 min. in a drying oven heated up to 100° C., whereby a thermal transfer material having an ink layer (coating amount after drying=15 g/m$^2$) was obtained.

In this instance. the breakdown strength of the resultant ink layer was 93 kg/cm$^2$ at 25° C.

COMPARATIVE EXAMPLE 8

| | |
|---|---|
| Montanic acid ester wax (Hoechst Wax E, mfd. by Hoechst, melting point (DSC) = 79-85° C.) | 61.2 wt. parts |
| Ethylene-vinyl acetate copolymer (Evaflex 220, mfd. by Mitsui Du Pont Polychemical K.K., vinyl acetate content = 28%, softening point (ring and ball method) = 90° C.) | 15.3 wt. parts |
| Aliphatic hydrocarbon resin (Piccotac B-BHT, mfd. by Hercules Co., softening point (ring and ball method) = 100° C., melt viscosity at 140° C. = 4 × 10$^3$ mPa.s) | 8.5 wt. parts |
| Carbon black (MA-11, mfd. by Mitsubishi Kasei K.K., particle size = 29 mμ, pH = 3.2) | 15.0 wt. parts |
| Toluene | 400 wt. parts |

The above components other than the carbon black were dissolved in toluene under heating, then the carbon black was added thereto, and the resultant mixture was dispersed by means of a sand mill at 2000 rpm for 30 min., thereby to prepare an ink.

Separately, a PET film having a thickness of 6 microns mm was coated with a back coating material in the same manner as in Example 14.

The above-mentioned ink was applied onto the surface of the PET film, which was reverse to that provided with the back coating, by means of a wire bar, and dried for 1 min. in a drying oven heated up to 100° C., whereby a thermal transfer material having an ink layer (coating amount after drying = 15 g/m$^2$) was obtained.

In this instance, the breakdown strength of the resultant ink layer was 18 kg/cm$^2$ at 25° C.

The above-mentioned thermal transfer materials of Examples 14–17 and Comparative Example 7 and 8 were evaluated. More specifically, images corresponding to "No. 8 Test Chart" described hereinabove were formed on a recording medium by using these thermal transfer materials by means of the same evaluation machine as in Example 1. The resultant images were evaluated with respect to the following evaluation items. The evaluation results are shown in Table 2 appearing hereinafter.

Item I

Formation of White Letter on Black Background

The ink layer of the thermal transfer material was transferred onto a white background of paper except for a portion thereof corresponding to letter images, whereby white letter images were formed in a solid black image portion.

At the boundary between the solid black portion and the white letter portion, since the resistance with which the thermal transfer material is rubbed with the recording medium by the medium of a melted ink, is considerably changed, white streaks are liable to occur in the solid black image portion.

Item II

Whisker Edge Portion

In a case where a solid black portion is continuously formed on a recording medium, when heat is stored on accumulated in a thermal head, a platen roller, and/or an ink layer, and the breakdown strength and melt viscosity of the ink layer are decreased, whisker edge portion is liable to occur.

Item III

Solid Black Image

At a solid black portion, since the contact area between a thermal transfer material and a recording medium is large, the adhesive strength therebetween becomes large, whereby the running of the recording medium and thermal transfer material is liable to be stopped.

Item IV

Transfer-Initiating Edge of Solid Black Image

When the ink cannot stably be transferred to a recording medium at the time of first heat application et seq., unevenness in transfer such as blurring, lacking or white streak is liable to occur.

Item V

Ground Staining

Since the thermal transfer material is rubbed with a recording medium in the double density recording, when the colored ink layer has a small breakdown strength and is brittle, a portion of the ink layer not supplied with heat is liable to transfer to a recording medium to cause ground staining.

TABLE 2

| | | Evaluation items | | | | |
|---|---|---|---|---|---|---|
| | | I | II | III | IV | V |
| Example | 14 | ○ | ○ | ○ | Δ | ○ |
| | 15 | Δ | ○ | ○ | Δ | ○ |
| | 16 | ○ | ○ | ○ | Δ | ○ |
| | 17 | ○ | ○ | ○ | Δ | ○ |
| Comp. Example | 7 | * | * | * | x | ○ |
| | 8 | ○ | x | ○ | ○ | x |

*: The transferability and fixability were poor and the evaluation was impossible.

In the above Table, the symbols have the following meanings:

○: The results were good.

Δ: The results were somewhat poor but were not problematic in practice.

x : The results were considerably poor and the resultant images were difficult to be used in practice.

EXAMPLE 18

| <Ink 1> | |
|---|---|
| Aliphatic hydrocarbon resin (Piccotac B-BHT, mfd. by Hercules Co., softening point = 100° C.) | 8 wt. parts |
| Ester wax (Hoechst Wax E, mfd. by Hoechst, melting point (DSC) = 79–85° C.) | 29 wt. parts |
| Ethylene-vinyl acetate copolymer (Evaflex 220, mfd. by Mitsui Du Pont Polychemical K.K., softening point = 90° C.) | 15 wt. parts |
| Ethylene-vinyl acetate copolymer (Evaflex 410, mfd. by Mitsui Du Point Polychemical K.K., softening point = 90° C.) | 34 wt. parts |
| Carbon black (MA-11, mfd. by Mitsubishi Kasei K.K.) | 15 wt. parts |
| Toluene | 900 wt. parts |

The above components other than the carbon black were dissolved in toluene and then the carbon black was added thereto, and the resultant mixture was dispersed by means of a sand mill at 2000 rpm for 30 min., thereby to prepare an ink 1.

| <Ink 2> | |
|---|---|
| Carnauba wax aqueous dispersion (Daijito T-10, mfd. by Goou Kagaku K.K., solid content = 30%, softening point of solid content = 75° C.) | 20 parts |
| Fluorine-containing surfactant (Surflon S-141, mfd. by Asahi Glass K.K., solid content = 30%) | 0.2 part |
| Ion exchange water | 10 parts |

The above-mentioned ink 1 was applied onto a 6 micron-thick PET film which had been back-coated in the same manner as in Example 14, by means of a wire bar and dried so as to provide an ink layer having a thickness of 18 microns (after drying). Onto the thus formed ink layer, the above-mentioned ink 2 was applied by means of a wire bar and dried so as to provide an ink layer having a thickness of 3 microns (after drying), whereby a thermal transfer material was obtained.

EXAMPLE 19

| | |
|---|---|
| Oxidized polyethylene (AC Polyethylene #5120, mfd. by Allied Chemical Co., softening point = 92° C.) | 10 parts |
| Toluene | 90 parts |

The above-mentioned material was dispersed in toluene to prepare an ink 3.

The above-mentioned ink 1 was applied onto a 6 micron-thick PET film which had been back-coated in the same manner as in Example 14, by means of a wire bar and dried so as to provide an ink layer having a thickness of 18 microns (after drying). Onto the thus formed ink layer, the above-mentioned ink 3 was applied by means of a wire bar and dried so as to provide an ink layer having a thickness of 2 microns (after drying), whereby a thermal transfer material was obtained.

EXAMPLE 20

The above-mentioned ink 1 was applied onto a 6 micron-thick PET film which had been back-coated in the same manner as in Example 14, by means of a wire bar and dried so as to provide an ink layer having a thickness of 18 microns (after drying). Onto the thus formed ink layer, the above-mentioned ink 2 was applied by means of a wire bar and dried so as to provide an ink layer having a thickness of 7 microns (after drying), whereby a thermal transfer material was obtained.

EXAMPLE 21

The above-mentioned ink 1 was applied onto a 6 micron-thick PET film which had been back-coated in the same manner as in Example 14, by means of a wire bar and dried so as to provide an ink layer having a thickness of 18 microns (after drying). Onto the thus formed ink layer, the above-mentioned ink 2 was applied by means of a wire bar and dried so as to provide an ink layer having a thickness of 0.3 microns (after drying), whereby a thermal transfer material was obtained.

EXAMPLE 22

| | |
|---|---|
| Montanic acid ester wax (Hoechst Wax E, melting point (DSC) = 79-85° C.) | 38.0 wt. parts |
| Ethylene-vinyl acetate copolymer (Evaflex 200, mfd. by Mitsui Du Pont Polychemical K.K., vinyl acetate content = 28%, softening point (ring and ball method) = 90° C.) | 42.0 wt. parts |
| Ethylene-vinyl acetate copolymer (Hoechst Wax 371 FP, mfd. by Hoechst, vinyl acetate content = 10%, melting point (DSC) = 97-102° C.) | 40.0 wt. parts |
| Carbon black (MA-11, mfd. by Mitsubishi Kasei K.K., particle size = 29 mμ, oil absorption (DBP-ml/100 g) = 65, pH = 3.2) | 15.0 wt. parts |
| Toluene | 400 wt. parts |

EXAMPLE 23

| | |
|---|---|
| Montanic acid ester wax (Hoechst Wax E, melting point (DSC) = 79-85° C.) | 39.9 wt. parts |
| Ethylene-vinyl acetate copolymer | 42.0 wt. parts |

-continued

| | |
|---|---|
| (Evaflex 200, mfd. by Mitsui Du Pont Polychemical K.K., vinyl acetate content = 28%, softening point (ring and ball method) = 90° C.) | |
| Ethylene-vinyl acetate copolymer (Hoechst Wax 371 FP, mfd. by Hoechst, vinyl acetate content = 10%, melting point (DSC) = 97-102° C.) | 40.0 wt. parts |
| Carbon black (MA-11, mfd. by Mitsubishi Kasei K.K., particle size = 29 mμ, oil absorption (DBP-ml/100 g) = 65, pH = 3.2) | 15.0 wt. parts |
| Toluene | 400 wt. parts |

EXAMPLE 24

| | |
|---|---|
| Montanic acid ester wax (Hoechst Wax E, melting point (DSC) = 79-85° C.) | 37.1 wt. parts |
| Ethylene-vinyl acetate copolymer (Evaflex 200 mfd. by Mitsui Du Pont Polychemical K.K., vinyl acetate content = 28%, softening point (ring and ball method) = 90° C.) | 38.3 wt. parts |
| Ethylene-vinyl acetate copolymer (Hoechst Wax 371 FP, mfd. by Hoechst, vinyl acetate content = 10%, melting point (DSC) = 97-102° C.) | 40.0 wt. parts |
| Carbon black (MA-11, mfd. by Mitsubishi Kasei K.K., particle size = 29 mμ, oil absorption (DBP-ml/100 g) = 65, pH = 3.2) | 15.0 wt. parts |
| Toluene | 400 wt. parts |

EXAMPLE 25

| | |
|---|---|
| Montanic acid ester wax (Hoechst Wax E, melting point (DSC) = 79-85° C.) | 38.0 wt. parts |
| Ethylene-vinyl acetate copolymer (Evaflex 200, mfd. by Mitsui Du Pont Polychemical K.K., vinyl acetate content = 28%, softening point (ring and ball method) = 90° C.) | 40.0 wt. parts |
| Ethylene-vinyl acetate copolymer (Yukaron-EVA V213K, mfd. by Mitsubishi Yuka K.K., vinyl acetate content = 5%, melting point (DSC) = 105° C.) | 7.0 wt. parts |
| Carbon black (MA-11, mfd. by Mitsubishi Kasei K.K., particle size = 29 mμ, oil absorption (DBP-ml/100 g) = 65, pH = 3.2) | 15.0 wt. parts |
| Toluene | 400 wt. parts |

The above-mentioned components were respectively mixed to prepare four species coating liquids and four species of thermal transfer materials were prepared by using the resultant coating liquids in the same manner as in Example 14 (Examples 22-25).

The respective ink layers showed the following breakdown strengths at 25° C.:

Example 22: 55 kg/cm$^2$
Example 23: 57 kg/cm$^2$
Example 24: 53 kg/cm$^2$
Example 25: 60 kg/cm$^2$

COMPARATIVE EXAMPLE 9

| | |
|---|---|
| <Ink 4> | |
| Aliphatic hydrocarbon (Piccotac B-BHT, mfd. by Hercules Co., softening point = 100° C.) | 10 parts |

-continued

| | |
|---|---|
| Ester wax (Hoechst Wax E, mfd. by Hoechst, melting point (DSC) 79-85° C.) | 15 parts |
| Ethylene-vinyl acetate copolymer (Evaflex 220, mfd. by Mitsui Du Pont Polychemical K.K., softening point = 90° C.) | 30 wt. parts |
| Ethylene-vinyl acetate copolymer (Evaflex 410, mfd. by Mitsui Du Point Polychemical K.K., softening point = 90° C.) | 33 wt. parts |
| Carbon black (MA-11, mfd. by Mitsubishi Kasei K.K.) | 15 wt. parts |
| Toluene | 900 wt. parts |

The above components other than the carbon black were dissolved in toluene and then the carbon black was added thereto, and the resultant mixture was dispersed by means of a sand mill at 2000 rpm for 30 min., thereby to prepare an ink 4.

The above-mentioned ink 4 was applied onto a 6 micron-thick PET film which had been back-coated in the same manner as in Example 14, by means of a wire bar and dried so as to provide an ink layer having a thickness of 18 microns (after drying), whereby a thermal transfer material was obtained.

COMPARATIVE EXAMPLE 10

| <Ink 5> | |
|---|---|
| Aliphatic hydrocarbon resin (Piccotac B-BHT, mfd. by Hercules Co., softening point = 100° C.) | 8 wt. parts |
| Ester wax (Hoechst Wax E, mfd. by Hoechst, melting point (DSC) = 79-85° C.) | 29 wt. parts |
| Ethylene-vinyl acetate copolymer (Evaflex 220, mfd. by Mitsui Du Pont Polychemical K.K., softening point = 90° C.) | 15 wt. parts |
| Ethylene-vinyl acetate copolymer (Evaflex 410, mfd. by Mitsui Du Point Polychemical K.K., softening point = 90° C.) | 34 wt. parts |
| Toluene | 900 parts |
| Fatty acid derivative (oleic acid amide, trade name: Amide O, mfd. by Lion-Akzo K.K., melting point = 70° C.) | 40 parts |
| Isopropyl alcohol | 60 parts |
| Carbon black | 18 parts |

Among the above components, the fatty acid derivative was dissolved in isopropyl alcohol.

Separately, the other components except carbon black were dissolved in toluene, and in the resultant solution, the above-mentioned isopropyl alcohol solution was mixed. Thereafter, the carbon black was added to the solution mixture, and the resultant mixture was dispersed by means of a sand mill at 2000 rpm for 30 min, thereby to prepare an ink 5.

The above-mentioned ink 5 was applied onto a 6 micron-thick PET film which had been back-coated in the same manner as in Example 14, by means of a wire bar and dried so as to provide an ink layer having a thickness of 18 microns (after drying), whereby a thermal transfer material was obtained.

The breakdown strength (at 25° C.) of the inks 1, 4 and 5 constituting the first ink layer of the thermal transfer materials of Examples 18-21 and Comparative Examples 9 and 10 were as follows:

Ink 1: 55 kg/cm$^2$

Ink 4: 90 kg/cm$^2$

Ink 5: 28 kg/cm$^2$

The thermal transfer materials of Examples 18-25 and Comparative Examples 9 and 10 were evaluated by using the same evaluation machine as in Example 1 with respect to the evaluation items which were the same as those shown in Table 2. The evaluation results are shown in the following Table 3.

TABLE 3

| | | Evaluation items | | | | |
|---|---|---|---|---|---|---|
| | | I | II | III | IV | V |
| Example | 18 | ○ | ○ | ○ | ○ | ○ |
| | 19 | ○ | ○ | ○ | ○ | ○ |
| | 20 | ○ | ○ | ○ | Δ*3 | ○ |
| | 21 | Δ*1 | ○ | ○ | ○ | ○ |
| | 22 | Δ | ○ | ○ | ○ | ○ |
| | 23 | Δ | ○ | ○ | ○ | ○ |
| | 24 | Δ | ○ | ○ | Δ | ○ |
| | 25 | Δ | ○ | ○ | ○ | ○ |
| Comp. Example | 9 | x*2 | ○ | x | x*4 | ○ |
| | 10 | ○ | x | ○ | ○ | ○ |

*1: A white streak having a width of 1 mm occurred.

*2: The running stability of the thermal transfer material considerably varied and the thermal transfer material was wrinkled.

*3: A blurred image portion having a length of about 3 mm occurred before stable transfer was effected.

*4: A blurred image portion having a length of about 5 mm occurred before stable transfer was effected.

In the above Table 3, the symbols of ○, Δ and x have the same meanings as those in Table 2.

As described hereinabove, the thermal transfer material according to the present invention provides clear images of good quality without causing ground staining, whisker edge portion or uneven edge portion, even when used in double density recording.

What is claimed is:

1. A thermal transfer recording method, comprising the steps of:

providing a thermal transfer material comprising a support and an ink layer disposed thereon in turn comprising a binder and a colorant, wherein said binder comprises 40-80 wt. % of an ethylene-vinyl acetate copolymer and 20-60 wt. % of a wax based on a total weight of the binder, and said ink layer has a breakdown strength of 30-80 kg/cm$^2$ at 25° C.;

contacting an ink layer side of said thermal transfer material with a recording medium;

supplying a pattern of energy from a recording head to said thermal transfer material; and separating said thermal transfer material from said recording medium to leave a transferred image on said recording medium;

wherein said thermal transfer material moves in a unit period of time by a first distance relative to said recording head which is smaller than a second distance through which said recording medium moves relative to said recording head in said same unit period of time.

2. A thermal transfer recording method according to claim 1, wherein said binder further comprises 5-15 wt. % thereof of a tackifier.

3. A thermal transfer recording method according to claim 2, wherein said tackifier has a softening point of 70°-110° C., and a melt viscosity of $2\times10^3$-$3\times10^4$ mPa.s at 140° C.

4. A thermal transfer recording method according to claim 2, wherein said tackifier comprises at least one species selected from a group consisting of an aliphatic hydrocarbon resin and an aromatic hydrocarbon resin.

5. A thermal transfer recording method according to claim 1, wherein said ink layer has a breakdown strength of 35-60 kg/cm$^2$ at 25° C.

6. A thermal transfer recording method comprising the steps of:

providing a thermal transfer material comprising a support and an ink layer disposed thereon in turn comprising a binder and a colorant, wherein said binder comprises 45-70 wt. % of an ethylene-vinyl acetate copolymer, 25-50 wt. % of a wax, and 7-12 wt. % of a tackifier based on a total weight of said binder, and said ink layer has a breakdown strength of 30-80 kg/cm$^2$ at 25° C.;

contacting an ink layer side of said thermal transfer material with a recording medium;

supplying a pattern of energy from a recording head to said thermal transfer material; and separating said thermal transfer material from said recording medium to leave a transferred image on said recording medium;

wherein said thermal transfer material moves in a unit period of time by a first distance relative to said recording head which is smaller than a second distance through which said recording medium moves relative to said recording head in said same unit period of time.

7. A thermal transfer recording method according to claim 6, wherein said tackifier has a softening point of 70°-110° C., and a melt viscosity of $2\times10^3$-$3\times10^4$ mPa.s at 140° C.

8. A thermal transfer recording method according to claim 6, wherein said tackifier comprises at least one species selected from a group consisting of an aliphatic hydrocarbon resin and an aromatic hydrocarbon resin.

9. A thermal transfer recording method according to claim 6, wherein said ink layer has a breakdown strength of 35-60 kg/cm$^2$ at 25° C.

10. A thermal transfer recording method, comprising the steps of:

providing a thermal transfer material comprising a support and at least an ink layer and a top layer, said ink layer being disposed on said support before said top layer, said ink layer in turn comprising at least a binder and a colorant, wherein said binder comprises 40-80 wt. % of an ethylene-vinyl acetate copolymer and 20-60 wt. % of a wax based on a total weight of said binder, and said ink layer has a breakdown strength of 30-80 kg/cm$^2$ at 25° C., and said top layer has said colorant in an amount which is ½ times or lower than an amount of said ink layer in terms of weight ratio;

contacting an ink layer side of said thermal transfer material with a recording medium;

supplying a pattern of energy from a recording head to said thermal transfer material; and separating said thermal transfer material from said recording medium to leave a transferred image on said recording medium;

wherein the thermal transfer material moves in a unit period of time by a first distance relative to said recording head which is smaller than a second distance through which said recording medium moves relative to said recording head in said same unit period of time.

11. A thermal transfer recording method according to claim 10, wherein said amount of said colorant of said top layer is 9%.

12. A thermal transfer recording method according to claim 10, wherein said binder further comprises 5-15 wt. % thereof of a tackifier.

13. A thermal transfer recording method according to claim 12, wherein said tackifier has a softening pint of 70°-110° C., and a melt viscosity of $2\times10^3$-$3\times10^4$ mPa.s at 140° C.

14. A thermal transfer recording method according to claim 12, wherein said tackifier comprises at least one species selected from a group consisting of an aliphatic hydrocarbon resin and an aromatic hydrocarbon resin.

15. A thermal transfer recording method according to claim 10, wherein said ink layer has a breakdown strength of 35-60 kg/cm$^2$ at 25° C.

* * * * *

UNITED STATES PATENT AND TRADEMARK OFFICE

CERTIFICATE OF CORRECTION

PATENT NO. : 5,268,704

DATED : December 7, 1993

INVENTOR(S) : TETSUO HASEGAWA, ET AL.

It is certified that error appears in the above-identified patent and that said Letters Patent is hereby corrected as shown below:

COLUMN 4

Line 26, "1/N" should read --1/N--.
Line 27, "1/N)" should read --1/N)--.
Line 42, "1/N," should read --1/N,--.
Line 46, "1" should read --1--.
Line 47, "1/N." should read --1/N.--.
Line 49, "1/N" should read --1/N--.

COLUMN 5

Line 37, "are" should read --were--.

COLUMN 6

Line 20, "flight." should read --slight.--.

COLUMN 7

Line 41, "added," should read --added--.

COLUMN 9

Line 64, "has" should read --have--.

COLUMN 13

Line 58, "using Example 1." should read --using the resultant coating liquids in the same manner as in Example 1.--.

UNITED STATES PATENT AND TRADEMARK OFFICE

CERTIFICATE OF CORRECTION

PATENT NO. : 5,268,704

DATED : December 7, 1993

INVENTOR(S) : TETSUO HASEGAWA, ET AL.

It is certified that error appears in the above-identified patent and that said Letters Patent is hereby corrected as shown below:

COLUMN 14

Line 64, "were" should read --was--.

COLUMN 15

Line 40, " ○:" should read -- ◎:--

COLUMN 19

Line 40, "stored on" should read --stored or--.

COLUMN 23

Line 43, "Carbon black" should read --Carbon black (MA-11, mfd. by Mitsubishi Kasei K.K.)--.

COLUMN 25

Line 4, "method" should read --method,--.

UNITED STATES PATENT AND TRADEMARK OFFICE

CERTIFICATE OF CORRECTION

PATENT NO. : 5,268,704

DATED : December 7, 1993

INVENTOR(S) : TETSUO HASEGAWA, ET AL.

It is certified that error appears in the above-identified patent and that said Letters Patent is hereby corrected as shown below:

COLUMN 26

Line 26, "9%." should read --0%.--.
Line 31, "pint" should read --point--.

Signed and Sealed this

Nineteenth Day of July, 1994

Bruce Lehman

*Attest:*

BRUCE LEHMAN

*Attesting Officer*

*Commissioner of Patents and Trademarks*